US006893365B2

(12) United States Patent
Rathbun et al.

(10) Patent No.: US 6,893,365 B2
(45) Date of Patent: May 17, 2005

(54) HOME PLATE TAPE MEASURE

(76) Inventors: Ruth E. Rathbun, 119 Stanley Dr., Williamsburg, VA (US) 23188; William J. Rathbun, 5433 Willow Bridge La., Fuquay-Varina, NC (US) 27526

( * ) Notice: Subject to any disclaimer, the term of this patent is extended or adjusted under 35 U.S.C. 154(b) by 0 days.

(21) Appl. No.: 10/216,690

(22) Filed: Aug. 12, 2002

(65) Prior Publication Data

US 2004/0029655 A1 Feb. 12, 2004

(51) Int. Cl.[7] ..... A63B 71/00

(52) U.S. Cl. ..... 473/500; 33/1 G; 33/1 H; 33/759

(58) Field of Search ..... 473/500, 423, 473/451, 449, 417, 501, 490, 176, 499, 218; 33/1 G, 1 H, 759, 709, 563, 456

(56) References Cited

U.S. PATENT DOCUMENTS 3,668,781 A * 6/1972 Teter ..... 33/1 H
3,971,558 A * 7/1976 Gardetto ..... 473/499
4,160,324 A 7/1979 Dunn
4,267,637 A 5/1981 Paull
4,381,607 A * 5/1983 Place ..... 33/1 G
4,880,232 A * 11/1989 Lang ..... 473/176
4,978,121 A 12/1990 Larkey
5,371,949 A 12/1994 Delaurier
5,556,090 A 9/1996 Coleman
5,642,880 A 7/1997 Wiseman et al.
5,657,984 A 8/1997 Leo
5,803,841 A 9/1998 Daskoski
6,026,585 A * 2/2000 Li ..... 33/767
6,430,819 B1 * 8/2002 Aldstadt et al. ..... 33/1 G
6,440,004 B1 * 8/2002 Rodriguez ..... 473/218

* cited by examiner

*Primary Examiner*—Gregory Vidovich
*Assistant Examiner*—M. Chambers
(74) *Attorney, Agent, or Firm*—Withrow & Terranova, PLLC

(57) ABSTRACT

A pitching assistance device resembles a home plate with a coiled measuring element stored therein. The measuring element may be selectively extended from the home plate structure to measure off a predefined distance, such as the regulation distance between a pitching mound and a home plate. Once measured, the distance may then be used by a pitcher for warming up or the creation of an improvised bullpen.

11 Claims, 5 Drawing Sheets

HOME PLATE TAPE MEASURE

FIELD OF THE INVENTION

The present invention relates to a device to assist pitchers in warming up before a game.

BACKGROUND OF THE INVENTION

Across America the spring and summer months bring a flurry of activity on baseball and softball fields. From Little League™ teams, to high school teams, to recreational summer leagues, people of all ages hit the fields for a bit of sport and relaxation. While the professional fields and many college fields have real bullpens, most high school and recreational fields do not have any sort of dedicated area which a pitcher can use to warm up before entering the game.

Further complicating matters for pitchers is the need to position themselves a requisite distance from a device symbolizing a home plate so that they warm up using the distance that they will be required to throw the ball during the game. While some recreational leagues are more social than competitive, this lack of a bullpen is disruptive for competitive Little League™, middle school, high school, and college teams.

Several devices have been proposed for laying out a ball field, but these devices are typically cumbersome and too complex for the creation of a temporary bullpen. Exemplary devices of this sort are illustrated in U.S. Pat. Nos. 4,160,324; 4,978,121; 5,556,090; and 5,803,841.

As another alternative, coaches or pitchers may bring a measuring tape with them to the game so that they can measure out an impromptu bullpen. Because of the distances involved between a typical pitching mound and the home plate, these measuring devices are usually purchased from the same sort that surveyors, real estate agents, and the like use for measuring yards, buildings and the like. While such measuring tapes are adequate for many purposes, there is still a need for a device that simply and efficiently allows the creation of an impromptu bullpen so that pitchers may warm up using a proper mimicry of a pitching mound to home plate distance.

SUMMARY OF THE INVENTION

The present invention addresses the need in the baseball/softball community for an impromptu bullpen by combining a home plate structure with a tape measure. The tape measure is preferably coiled within the home plate structure and selectively extended therefrom as needed to mark out a bullpen pitching area.

The home plate structure may be a regulation size home plate, having sufficient thickness to house the tape measure. In an exemplary embodiment, the home plate structure is made from a durable plastic material, such as through a blow molding process.

The measuring tape may have several embodiments, which are not necessarily mutually exclusive. The measuring tape may have several distances indicated thereon, so as to be useful for Little League™ teams, softball teams, high school baseball teams, and college teams, each of which has a different distance from the pitching mound to the home plate. The measuring tape may further be made from a number of different materials such as a weed cutting line, a cloth tape measure, a semi-rigid metallic measuring line, or the like.

Those skilled in the art will appreciate the scope of the present invention and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the invention, and together with the description serve to explain the principles of the invention.

DETAILED DESCRIPTION OF THE PREFERRED EMBODIMENTS

Figure 1:
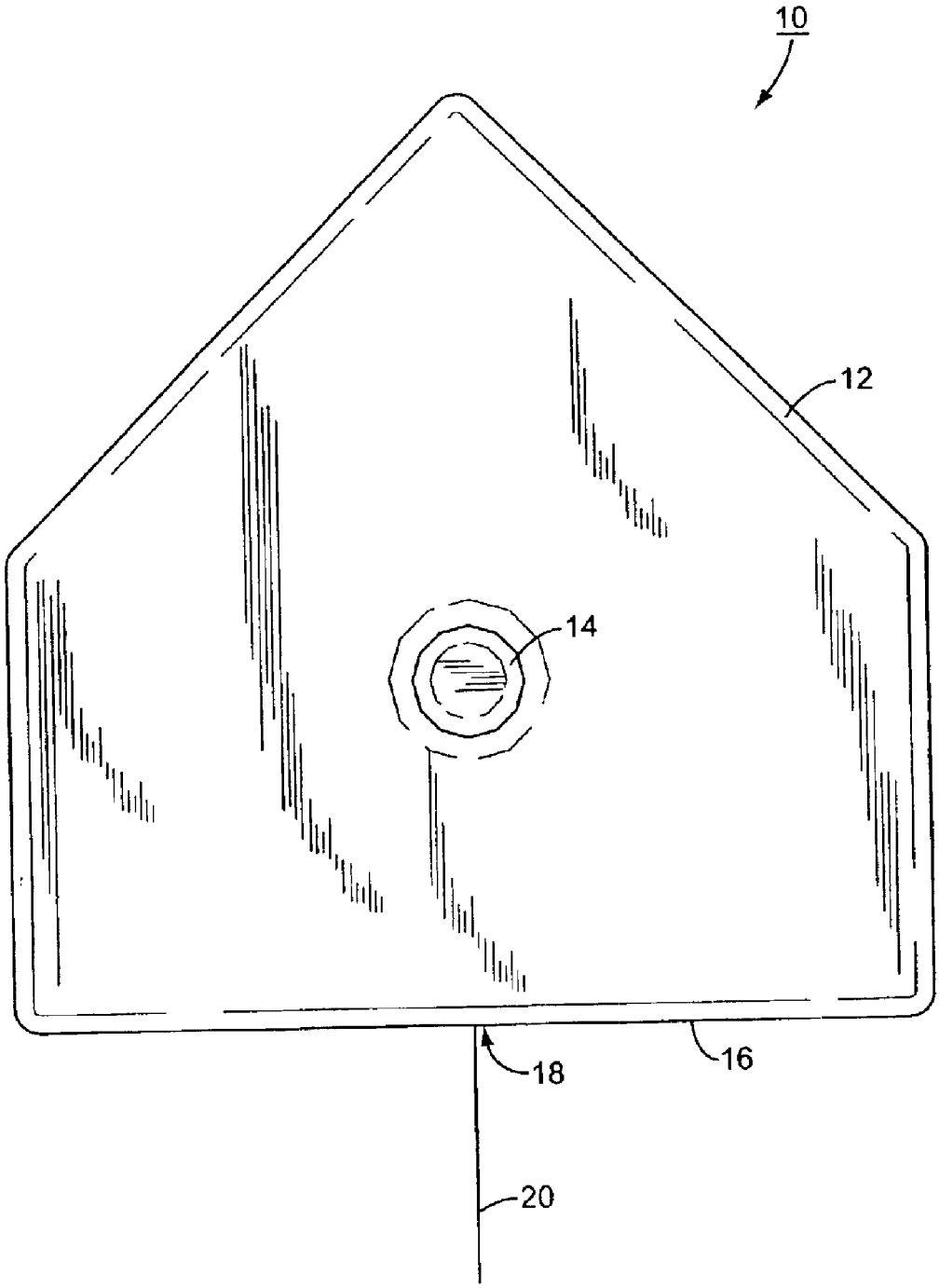
FIG. 1 illustrates a top plan view of the home plate structure of an exemplary embodiment of the present invention with the tape measure extended.

The embodiments set forth below represent the necessary information to enable those skilled in the art to practice the invention and illustrate the best mode of practicing the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

The present invention provides a readily portable, easy to use temporary bullpen device for assisting pitchers during warm ups in locations where a predefined bullpen is not available. It is also well suited for random pitching practice where a ball field or bullpen is not readily available. To this end, an exemplary embodiment of the present invention is illustrated in the accompanying figures. A pitching assistance device 10 is generally illustrated from a top plan view in FIG. 1. The pitching assistance device 10 comprises a pentagon shaped housing 12, which is shaped to mimic a home plate structure. The rules of Major League Baseball indicate that home plate should be a seventeen inch square with two corners cut off to form a pentagon such that there is a seventeen inch side, two adjacent eight and one half inch sides, and two twelve inch sides that come together to form a point. There does not appear to be an official thickness associated with home plate, but the present invention is designed to mimic the top plan surface of an official home plate, without regard to an official thickness. The pentagon shaped housing 12 includes an axle 14 and a linear edge 16. The linear edge 16 delimits an aperture 18 through which a measuring element 20 may be selectively extended. The presence of the measuring element 20 may cause the thickness of the pentagon shaped housing 12 to differ from that of an official home plate.

Figure 2:
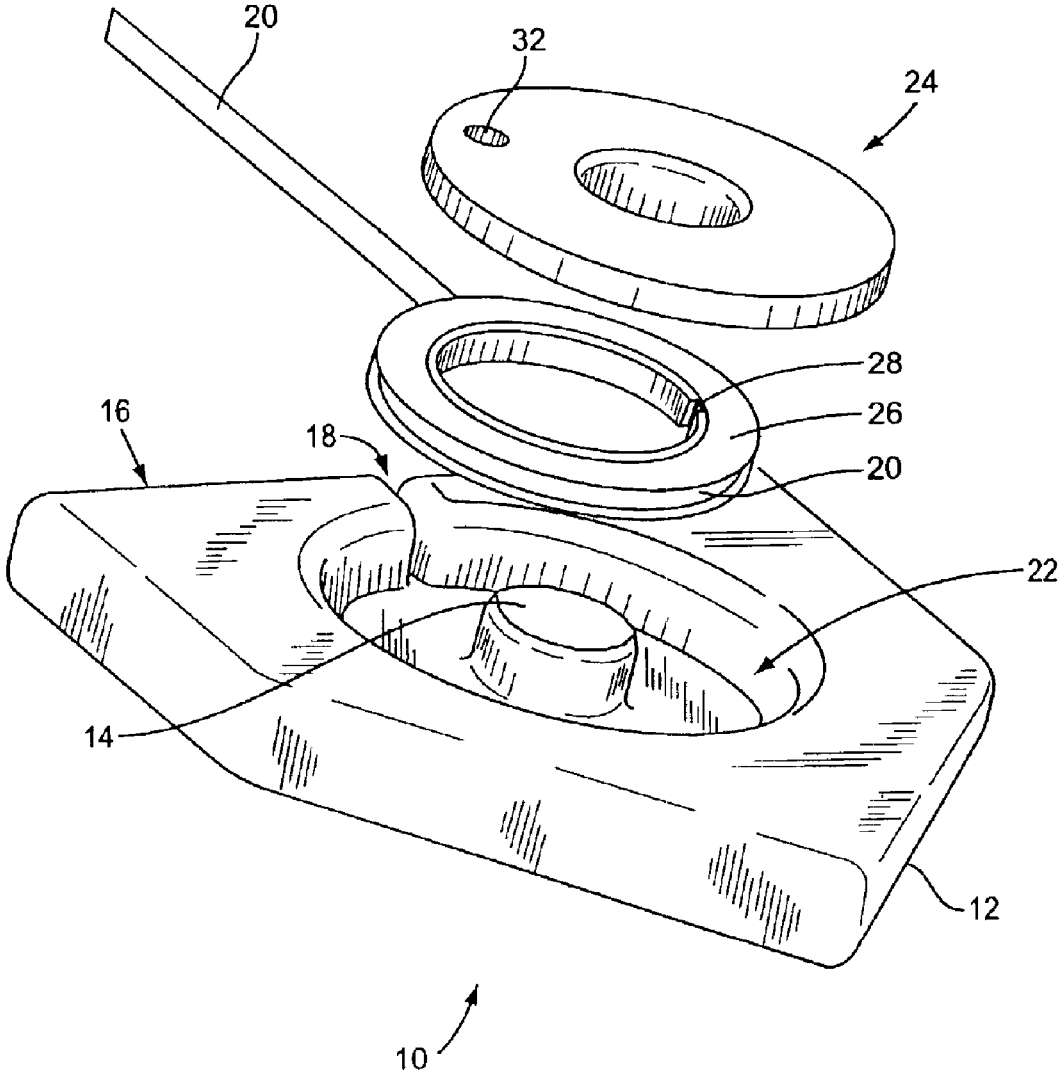
FIG. 2 illustrates an exploded bottom perspective view of the home plate structure of FIG. 1.

As better illustrated in FIG. 2, the pentagon shaped housing 12 may further define a recess 22 surrounding the axle 14, which may be snap fit with a winding mechanism 24. The winding mechanism 24 cooperates with the axle 14 to house the measuring element 20 therebetween and selectively coil and uncoil the measuring element 20 for use. In an exemplary embodiment, the measuring element 20 is wound about a spool 26 which includes a slot 28 that interacts with a protuberance 30 (FIG. 3) positioned on the winding mechanism 24. The protuberance 30 fits within the slot 28, and as the winding mechanism 24 is rotated about the axle 14, the protuberance 30 causes the spool 26 to rotate concurrently. This motion wraps or unwraps the measuring element 20 as is well understood. It should be appreciated that the protuberance 30 could be positioned on the spool 26 and the slot 28 could be positioned on the winding mechanism 24 if needed or desired.

Figure 3:
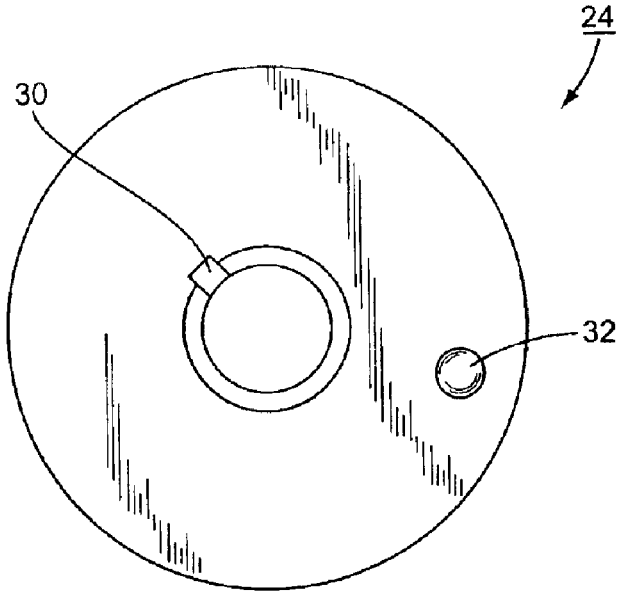
FIG. 3 illustrates an inner surface of a winding mechanism for the present invention.

As can be seen in FIGS. 2 and 3, the winding mechanism 24 also includes a finger divot 32 or recess which allows a user to insert a finger or other elongate object to facilitate turning of the winding mechanism 24.

In an exemplary embodiment, the pentagon shaped housing 12, the winding mechanism 24 and/or the spool 26 may be made from a durable material such as plastic, and, in a preferred embodiment, one or more of these elements is made from a blow molding process from recycled materials. As previously noted, the winding mechanism 24 may be snap fit into the recess 22. Other materials and/or manufacturing techniques may be used; however, the preferred embodiment reflects a good compromise between durability, weight, and manufacturing economics.

Note further that aperture 18 may be a slot (illustrated in FIG. 2) such that the measuring element 20 is exposed for a portion of the lower surface of the pentagon shaped housing 12. Alternatively, that slot may be enclosed such that the measuring element 20 is enclosed except through aperture 18.

Figure 4:
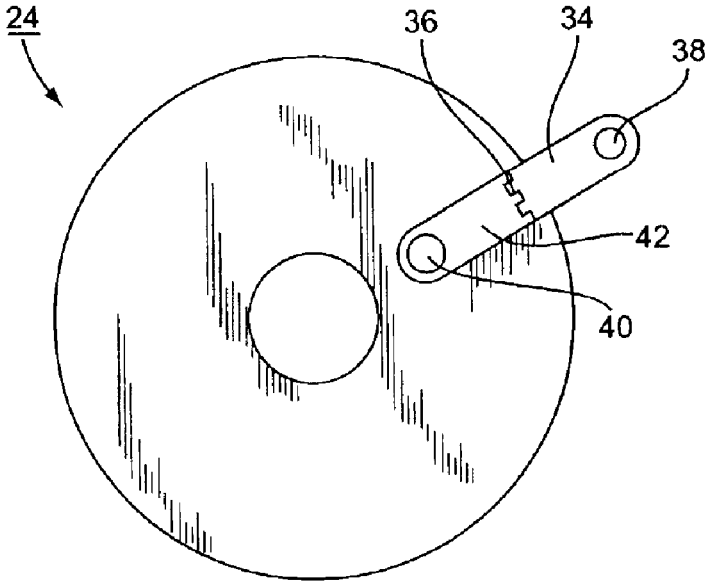
FIG. 4 illustrates an alternate embodiment of a winding mechanism.

While a relatively simple winding mechanism 24 is illustrated in FIGS. 1–3, other winding mechanisms may also be used. For example, a spring loaded winding mechanism akin to those found in conventional tape measures that are selectively actuated to retract the measuring element 20 may be used, effectively eliminating the need for manual winding of the measuring element 20. Alternatively, a swing arm 34 as illustrated in FIG. 4 may be incorporated into the winding mechanism 24 and selectively extended around a hinge 36. A rotatable knob 38 may assist in use of the swing arm 34. When closed, the knob 38 may fit within a recess 40 within a cavity 42 that holds the swing arm 34 when not in use. In this manner, the swing arm 34 is flush within the cavity 42 when not in use, but is selectively extendable such that the knob 38 and swing arm 34 may be used to assist in winding the measuring element 20 when needed.

Figure 5:
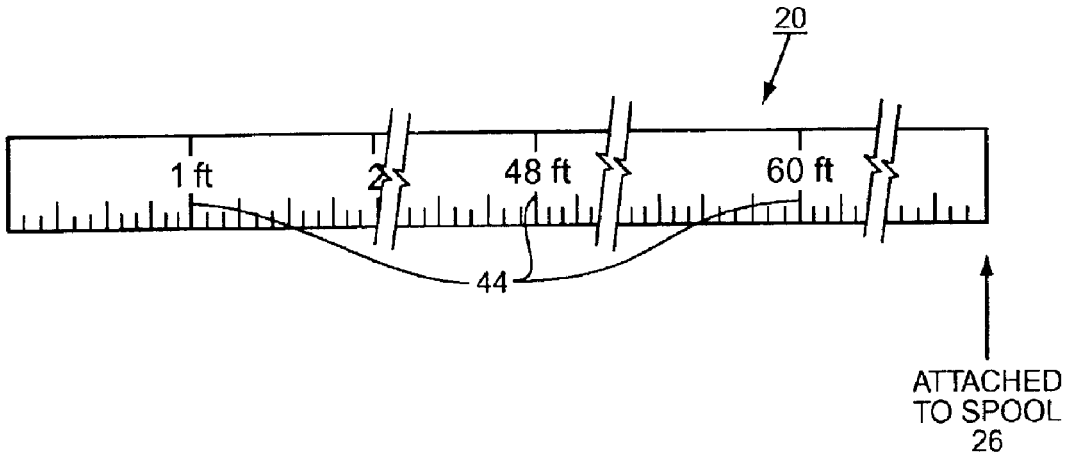
FIG. 5 illustrates a partial view of the tape measure according to an exemplary embodiment of the present invention with multiple distances indicated.

The measuring element 20 is illustrated in fragmented form in FIG. 5, wherein marking indicia 44 are incorporated into the measuring element 20 to indicate certain predefined distances. In one embodiment, only one indicium 44 is used to denote a single predefined distance. For example, a distance of forty-six feet may be used to denote the defined distance between pitching mound and home plate for Little League™. Alternatively, sixty feet, six inches may be marked to denote Major League Baseball or the like. Other distances may also be used if needed or desired. In a more preferred embodiment, multiple predefined distances may be denoted by indicia 44 thereby making the pitching assistance device 10 suitable for use in multiple environments. A comprehensive list of distances to include on the measuring element is difficult, especially since official distances sometimes change from year to year. However, an exemplary, non-exhaustive list of leagues that may be covered include, but is not limited to Little League™ (both baseball and softball), Amateur Softball Association (ASA), Amateur Athletic Union (AAU) (both baseball and softball), National Softball Association, United States Specialty Sports Association (both baseball and softball), National Federation of State High School Association (both baseball and softball), National Collegiate Athletics Association (NCAA, both baseball and softball), Pony League (both baseball and softball), Cal Ripkin League, Babe Ruth League (baseball and softball), International Softball Federation, American Legion, and the like. These leagues and their various levels of play could all be denoted on the measuring element 20 with the indicia 44.

In the embodiment of FIG. 5, the measuring element 20 is illustrated to represent a flat, cloth or synthetic measuring tape as is sometimes used in a surveyor's measuring tape. Alternate embodiments allow for different sorts of measuring elements such as a round nylon weed trimming line, a flat semi-rigid metallic measuring line, a chain, a string, or the like. Indicia 44 may, in these alternate embodiments, be a legible marking with alphanumeric characters used to denote distances or may be knots or the like as needed or desired. In still another embodiment, color coded dots or markings could be used in conjunction with any of the different embodiments of measuring element 20, and the color code may be duplicated with a translation table on the pentagon shaped housing 12 for ease of reference. In the event that the indicia 44 represent a more conventional tape measure with inches and feet denoted thereon, a chart indicating the appropriate distances for each class of ball field may be printed on the pentagon shaped housing 12. Nothing precludes multiple embodiments of the indicia 44 from being used concurrently.

Against the backdrop of equipment, a brief explanation of how the pitching assistance device 10 may be used may be helpful in explicating the present invention. A user purchases the present invention (block 100) through conventional channels such as a sporting good store, the Internet, or the like. The pitching assistance device 10 may be packed with other sporting paraphernalia for travel to a ballpark or other recreational vehicle (block 102). Upon reaching a situation where a pitcher needs or wants to practice pitching or warm up, the pitching assistance device 10 may be retrieved (block 104). The pentagon shaped housing 12 is positioned in a first location (block 106) and the measuring element 20 extended therefrom (block 108). The measuring element 20 is extended to the distance corresponding to the particular league in which the pitching is desired. Once extended, the user may mark the position and/or leave the measuring element 20 extended and begin pitching (block 110). In this manner, the pitcher is assured that they are throwing the ball the desired distance, even when there is not a predefined bullpen.

Figure 6:
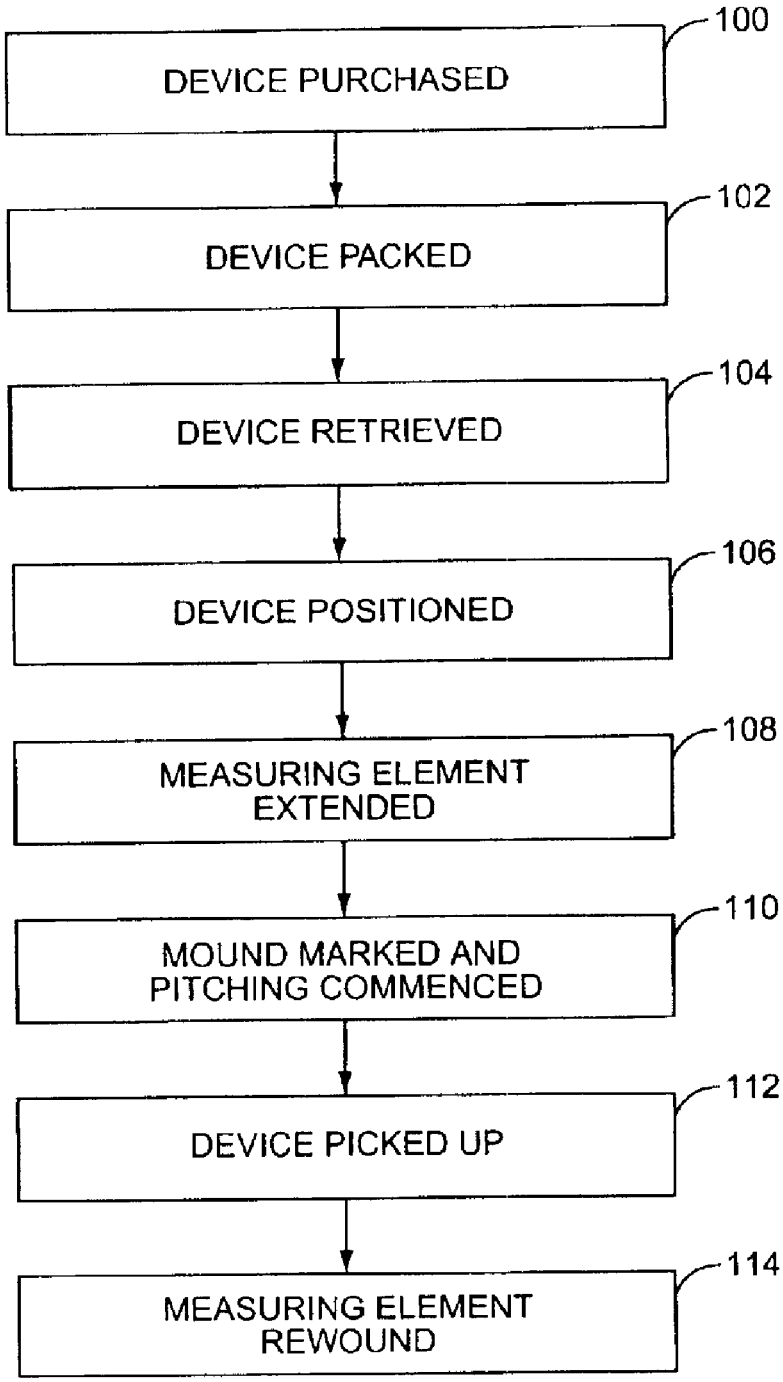
FIG. 6 illustrates in a flow chart format the methodology of the present invention.

After completion of the warm up or practice session, the pitching assistance device 10 is retrieved, such as by picking up the device 10 (block 112) and the measuring element 20 is wound back into the device (block 114) such as by rotation of the winding mechanism 24. The pitching assistance device 10 may be placed back in a gym bag or the like until the next desired usage. As is readily apparent, the pitching assistance device 10 is readily portable and easily able to be set up in almost any location so that a pitcher may practice or warm up. Use of the device is not limited to improvised bullpens, but may also be used in a home or other recreational environment where people desire to know that they are throwing the ball a predefined distance, such as the one corresponding to the distance between a pitching mound and a home plate. Note that the methodology of FIG. 6 is purely exemplary and that other sequences of events may also occur in the normal use of the pitching assistance device 10.

Those skilled in the art will recognize improvements and modifications to the preferred embodiments of the present invention. All such improvements and modifications are considered within the scope of the concepts disclosed herein and the claims that follow.

What is claimed is:

1. A pitching assistance device consisting essentially of:

a pentagon shaped housing conforming to dimensions of a home plate according to standard play regulations and adapted to use as a home plate, said pentagon shaped housing constructed from a plastic material, said housing delimiting an aperture;

an axle integrally formed with said housing;

said pentagon shaped housing comprising a linear edge, said linear edge delimiting an aperture;

a measuring element adapted to extend selective from said housing through said aperture;

a winding mechanism cooperating with said axle to house the measuring element therebetween, said winding mechanism used to coil and uncoil selectively the measuring element, said winding mechanism including a finger divot to assist in operation of said winding mechanism.

2. A pitching assistance device, comprising:

a pentagon shaped housing conforming to dimensions of a home plate according to standard play regulations and adapted to use as a home plate; and a measuring element positioned within said housing and selectively extendable therefrom such that a predefined distance may be measured therewith;

a winding mechanism for selectively retracting said measuring element into said housing;

an axle positioned within said pentagon shaped housing; and a spool, said measuring element wound about said spool, said spool rotating about said axle, and wherein said winding mechanism and said spool collectively comprise a protuberance and slot such that when said winding mechanism is rotated, said spool rotates concurrently.

3. The pitching assistance device of claim 2, wherein said measuring element comprises indicia to indicate a plurality of predefined distances such that the pitching assistance device may be used to layout impromptu bullpens for a plurality of different play levels.

4. The pitching assistance device of claim 2, wherein said pentagon shaped housing comprises a linear edge delimiting an aperture through which the measuring element is extended.

5. The pitching assistance device of claim 2, wherein said pentagon shaped housing is constructed from a plastic material.

6. The pitching assistance device of claim 2, wherein said measuring element comprises a weed trimming line.

7. The pitching assistance device of claim 2, wherein said measuring element comprises a tape measure.

8. The pitching assistance device of claim 2, wherein said pentagon shaped housing is constructed from a blow molded plastic material.

9. The pitching assistance device of claim 2, further comprising a finger divot to assist in operation of said winding mechanism.

10. The pitching assistance device of claim 2, wherein said measuring element comprises at least one indicium thereon for denoting a predefined distance.

11. The pitching assistance device of claim 2, wherein said winding mechanism is adapted to snap fit within a recess.

* * * * *